US007438559B2

(12) United States Patent
Ryu et al.

(10) Patent No.: US 7,438,559 B2
(45) Date of Patent: Oct. 21, 2008

(54) CONTACT SPRING

(75) Inventors: Jun Hee Ryu, Gyungsangbook-Do (KR); Kap Jin Lee, Gwangju-Si (KR)

(73) Assignee: LG Innotek Co., Ltd., Seoul (KR)

( * ) Notice: Subject to any disclaimer, the term of this patent is extended or adjusted under 35 U.S.C. 154(b) by 47 days.

(21) Appl. No.: 10/578,910

(22) PCT Filed: Jun. 28, 2005

(86) PCT No.: PCT/KR2005/002020

§ 371 (c)(1),
(2), (4) Date: May 12, 2006

(87) PCT Pub. No.: WO2006/004335

PCT Pub. Date: Jan. 12, 2006

(65) Prior Publication Data

US 2007/0082559 A1 Apr. 12, 2007

(30) Foreign Application Priority Data

Jun. 30, 2004 (KR) ..... 10-2004-0049880

(51) Int. Cl.
*H01R 12/00* (2006.01)

(52) U.S. Cl. ..... 439/66; 439/862

(58) Field of Classification Search ..... 439/66, 439/81, 500, 862
See application file for complete search history.

(56) References Cited

U.S. PATENT DOCUMENTS

| | | | | |
|---|---|---|---|---|
| 4,884,052 | A | 11/1989 | Eitoku et al. | |
| 5,197,889 | A * | 3/1993 | Rizzo et al. | 439/76.1 |
| 5,259,769 | A | 11/1993 | Cruise et al. | |
| 5,749,737 | A * | 5/1998 | Zuin | 439/500 |
| 6,381,199 | B1 * | 4/2002 | Kroner et al. | 368/203 |
| 6,692,266 | B2 | 2/2004 | Hashiguchi et al. | |
| 6,764,332 | B2 * | 7/2004 | Sato | 439/382 |

FOREIGN PATENT DOCUMENTS

JP 8-17499 A 1/1996

* cited by examiner

*Primary Examiner*—Khiem Nguyen
(74) *Attorney, Agent, or Firm*—Birch, Stewart, Kolasch & Birch, LLP

(57) ABSTRACT

A contact spring comprises: a support portion connected to electrical equipment; a contact portion electrically connected to an external power supply terminal; at least two bent portions connected between the support portion and the contact portion and having a bent shape.

12 Claims, 4 Drawing Sheets

[Figure 1]
BACKGROUND ART
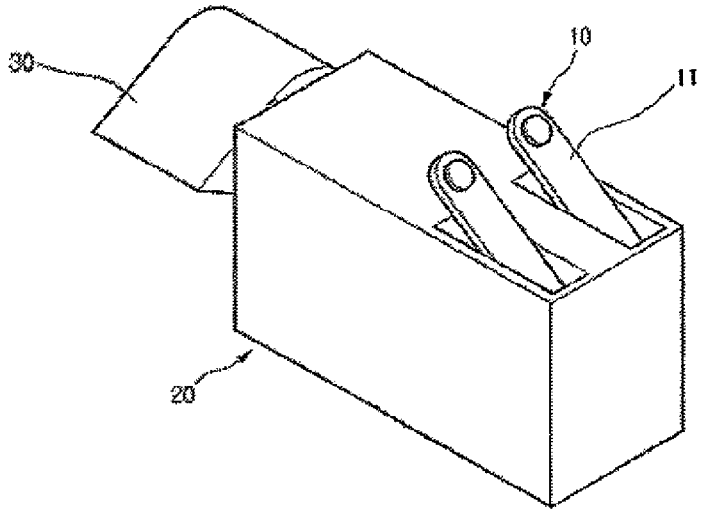

【Figure 2】
BACKGROUND ART
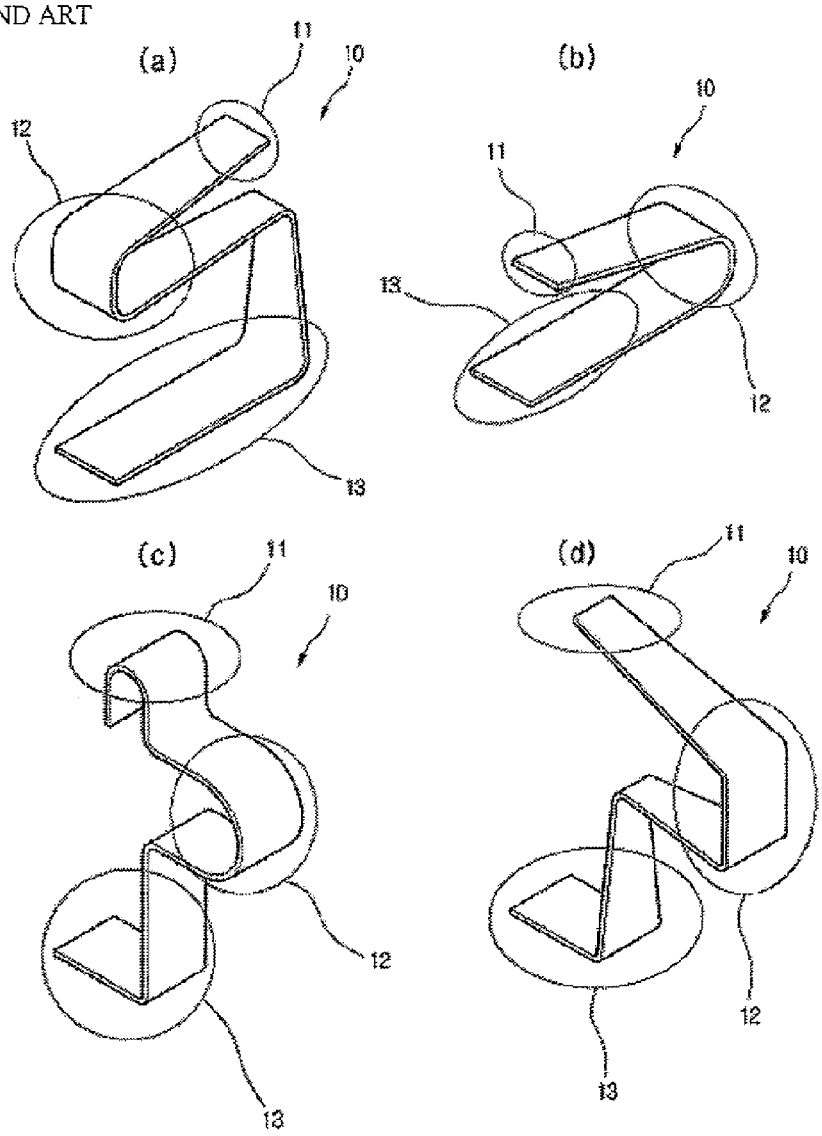

[Figure 3]
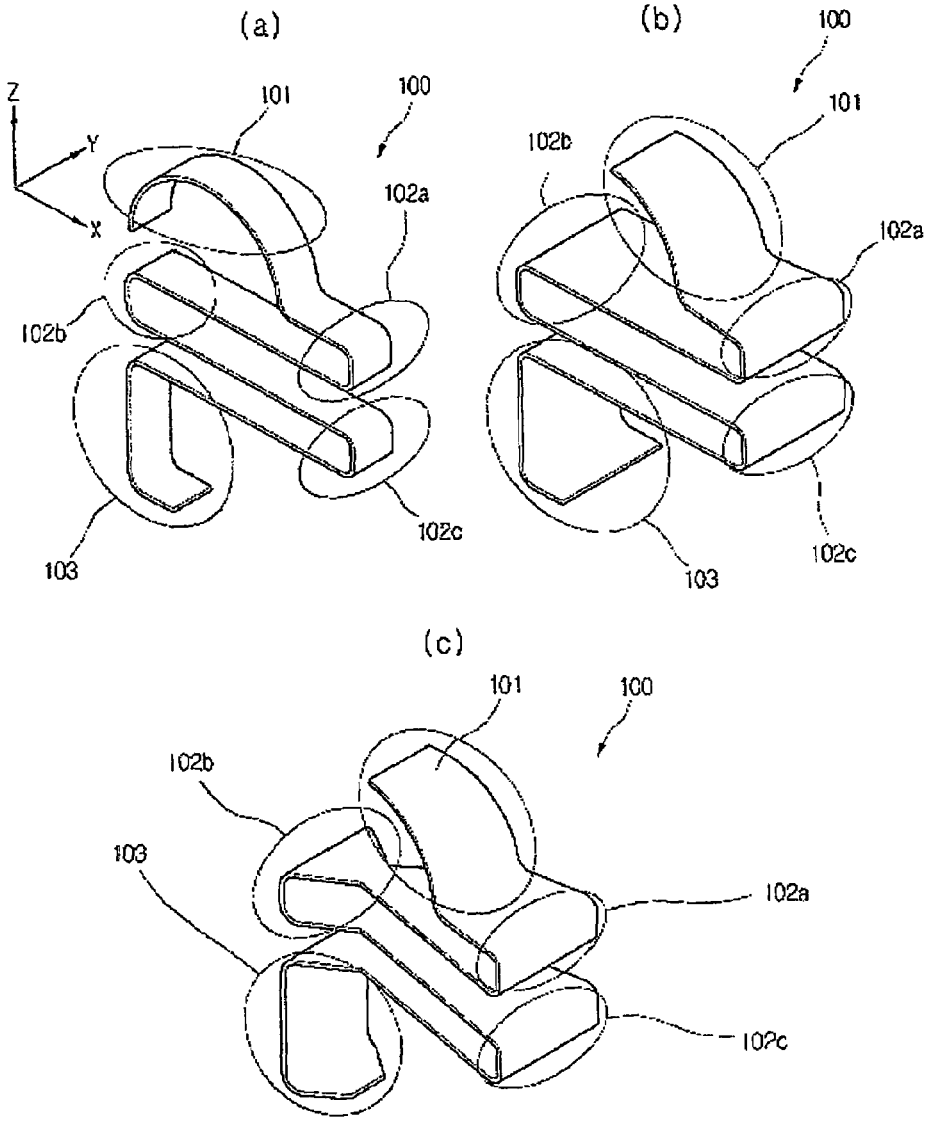

【Figure 4】
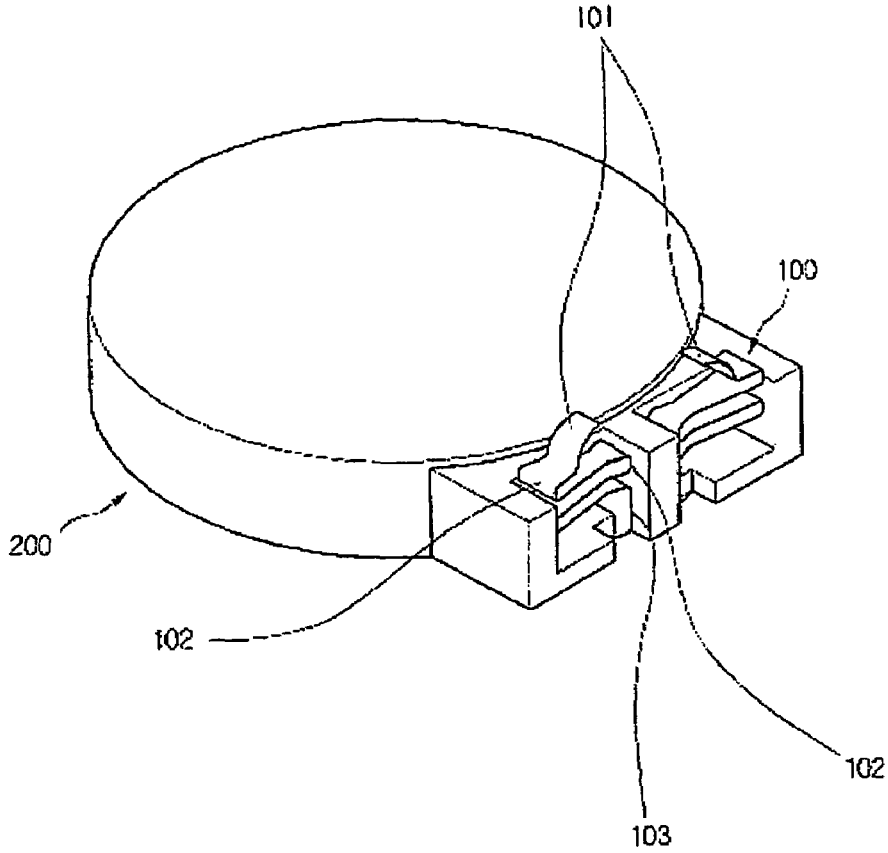

CONTACT SPRING

TECHNICAL FIELD

The present invention relates to a spring structure, and more particularly, to a contact spring structure used as a power supply terminal for electrical equipment.

BACKGROUND ART

The methods for supplying power to a vibration motor, a kind of reception sensor of a mobile communication terminal as an example of electrical equipment, include lead wire soldering, the direct soldering of a FPCB of a terminal and a FPCB land of a vibrating motor, a supply method using a connector, a supply method using a contact spring attached to a vibration motor.

FIG. 1 is a view schematically showing a bar type vibration motor with a contact spring mounted thereon according to the related art.

As shown in FIG. 1, in the supply method using a contact spring 10, when a vibration motor 20 with a contact spring mounted thereon is secured to a terminal structure, and a terminal PCB designed according to the location of the contact spring 10 is secured to the terminal structure, a PCB land connected to a terminal power source comes into contact with the contact spring 10, whereby the weight 30 of the vibration motor 20 is eccentrically rotated to generate vibration.

To ensure smooth power supply through a contact between the contact spring 10 and the PCB land of the terminal, the contact spring 10 has to maintain a proper level of repulsive force, and has to be designed so that the contact of the contact spring 10 may not deviate from the PCB land of the terminal.

FIG. 2 is a view showing a contact spring structure used for a vibration motor according to the related art.

Referring to (a) through (d) of FIG. 2, the related art contact spring 10 is of an integral type, roughly comprising a contact portion 11 contacting a PCB land connected to an external power source, a support portion 13 directly secured to the vibration motor or contacting the same, and a bent portion 12 connecting between the contact portion 11 and the support portion 13.

The contact portion 11 is basically formed in an arc-shaped curve in order to reduce the amount of change in the position of the contact with the PCB land of the terminal according to the amount of compression of the spring and increase the reliability of a connection between the PCB land and the contact, or may be embossed in the shape of a semispherical or arc-shaped strip.

The support portion 13 is constructed of a horizontal surface, a vertical surface, or a combination of a horizontal surface and a vertical surface, and may be constructed in various shapes according to the type of a vibration motor used or limiting conditions of instruments. Further, a soldering form for electrically connecting a coil end of the motor and the contact spring 10 may be added to the support portion 13, or alternatively they may be electrically connected by soldering or welding.

The bent portion 12 is basically constructed in a shape similar to a '⊂' shape or its symmetrical shape, or may be constructed in a complete semispherical shape according to whether fillet treatment is done or not.

In the related art contact spring structure, most parts of the energy stored in the contact spring as the contact spring is compressed are concentrated on the bent portion 12, and the energy is proportional to the square of a strain.

At this time, the intensity of stress generated in the contact spring is proportional to the amount of strain by Hook's Law (stress=Young's modulus×strain). If a stress exceeding the threshold of the spring as represented by a tensile strength is generated, there may occur a phenomenon that the contact spring is permanently deformed.

In case of such a permanent deformation, there is a risk that the size of a repulsive force, generated when the contact between the PCB land of the terminal and the contact spring are compressed, may be reduced lower than a proper level, and thereby a power supply to the vibration motor is not done smoothly.

Moreover, the elastic modulus (k) of the spring is proportional to the thickness (T) of spring material and the surface area (A) of the bent portion, and the energy (E) stored in the bent portion is expressed as a function of the elastic modulus (k) and of the amount of compression (x). Further, the volume (V) of the bent portion is equal to the product of the thickness of spring material and the surface area (A).

In other words, in $k \propto T^3 A$, $$E = \frac{1}{2}kx^2,\ V = T \cdot A,$$

the energy (E/V) stored per unit volume of the spring is expressed by $$\frac{E}{V} \alpha \frac{1}{2} r^2 x^2$$

As described above, while the energy density per unit volume represented by a strain-energy density is proportional to the square of a strain and of a spring thickness (T), it is almost not affected by the surface area (A).

To increase the elastic modulus while keeping a constant amount of compression in such a related art contact spring structure, a method of increasing the thickness of the material or increasing the width of the surface area of the bent portion may be employed.

However, the stress generated by an increase of the thickness of the spring material increases in proportion to the thickness (T), thus reducing the durability.

Further, because the contact of the contact portion rotates relative to the bent portion, which is a region where the stress is concentrated, the contact moves in a direction perpendicular to the compression direction and may deviate from the PCB land of the terminal. If the length of the bent portion is increased in order to prevent an increase of the stress, the rotation center of the contact becomes far from the contact to thereby increase the amount of movement of the contact in a direction perpendicular to the compression direction.

DISCLOSURE

Technical Problem

Accordingly, it is an object of the present invention to propose a shape of a contact spring having a high elastic modulus while keeping a constant amount of compression, and provide a contact spring, which can attain durability by alleviating the phenomenon of concentration of a stress distributed over a contact spring, so that the magnitude of the generated stress may not exceed the tensile strength of contact spring material.

Furthermore, it is another object of the present invention to provide a vibration motor with a contact spring, which can attain durability by alleviating the phenomenon of concentration of a stress distributed over a contact spring, so that the magnitude of the generated stress may not exceed the tensile strength of contact spring material.

Technical Solution

To achieve one of the objects, there is provided a contact spring according to the present invention, comprising: a support portion connected to electrical equipment; a contact portion electrically connected to an external power supply terminal; and at least two bent portions connected between the support portion and the contact portion and having a bent shape.

To achieve the other object, there is provided a vibration motor according to the present invention, comprising: a contact spring provided with a support portion, a contact portion electrically connected to an external power supply terminal and at least two bent portions connected between the support portion and the contact portion and having a bent shape; and a vibrating portion eccentrically rotating by power supplied from outside through the support portion.

ADVANTAGEOUS EFFECTS

According to the present invention, the strain-energy density stored in the bent portions of the contact spring is reduced, and thus the magnitude of the stress distributed over the bent portions is reduced, thereby providing a contact spring having a higher durability.

Furthermore, according to the present invention, the rotation phenomenon of the contact is reduced by adjusting the width of each bent portion and bent portion joint according to the relative location of the contact portion and the bent portion, and thus the amount of change in the relative location of the PCB land of the terminal and the contact can be reduced. Furthermore, the contact spring is prevented from permanent deformation due to compression by uniformly dispersing the stress distributed over each bent portion by adjusting the width of the bent portion.

DESCRIPTION OF DRAWINGS

FIG. 1 is a view schematically showing a bar type vibration motor with a contact spring mounted thereon according to the related art.

FIG. 2 is a view showing a contact spring structure used for a vibration motor according to the related art.

FIG. 3 is a view showing various embodiments of a contact spring according to the present invention.

FIG. 4 is a view showing a coin type vibration motor for which a contact spring is used according to the present invention.

MODE FOR INVENTION

FIG. 3 is a view showing various embodiments of a contact spring according to the present invention.

Referring to (a) through (c) of FIG. 3, the contact spring 100 according to the invention is of an integral type, roughly comprising a contact portion 101 contacting a PCB land connected to an external power source, a support portion 103 directly secured to the vibration motor or contacting the same, and bent portions 102*a* to 102*c* connecting between the contact portion 101 and the support portion 103.

More concretely, the contact portion 101 is basically formed in an arc-shaped curve bent with a given curvature in order to reduce the amount of change in the position of the contact with the PCB land of the terminal according to the amount of compression of the contact spring and increase the reliability of a connection between the PCB land and the contact, or may be embossed in the shape of a semispherical or arc-shaped strip.

The support portion 103 is constructed of a horizontal surface, a vertical surface, or a combination of a horizontal surface and a vertical surface, and may be constructed in various shapes according to the type of a vibration motor used or limiting conditions of instruments. Further, a soldering form for electrically connecting a coil end of the motor and the contact spring 100 may be added to the support portion 103, or alternatively they may be electrically connected by soldering or welding.

The contact portion 101 and the support portion 103 are connected to at least two bent portions 102*a* to 102*c*. The bent portions 102*a* to 102*c* are constructed in a shape similar to a '⊂' shape bent approximately perpendicularly or its symmetrical shape. Here, the bent portions 102*a* to 102*c* may be constructed in a complete semispherical shape according to whether fillet treatment is done or not.

In the contact spring structure having the above construction according to the present invention, most parts of the energy stored as the contact spring is compressed are stored dispersed in the bent portions 102*a* to 102*c*, and the density of the energy stored in the bent portions 102*a* to 102*c* can be represented by a strain-energy density.

Here, the strain-energy density stored in the bent portions 102*a* to 102*c* is proportional to the square of a strain. At this time, the intensity of stress generated is proportional to the strain of the spring by Hook's Law (stress=Young's modulus×strain).

The energy stored in the contact spring structure according to the present invention is stored dispersed through two or more bent portions 102*a* to 102*c*. Accordingly, the strain-energy density stored in the respective bent portions 102*a* to 102*c* becomes lower, and the intensity of the stress generated is also reduced.

Meanwhile, in order to increase the repulsive force (contact force) or elastic modulus (stiffness) of the spring in a given amount of compression without increasing the intensity of the stress generated in the bent portions 102*a* to 102*c*, the energy density of the bent portions 102*a* to 102*c* has to be kept constant.

To keep a constant energy density of the bent portions while increasing the repulsive force, it is advantageous to increase the width of the bent portions rather than the width of spring material.

This is because the elastic modulus (k) is $k \propto T^3 A$ and proportional to the cube of the thickness (T) of the spring material while the energy (E/V) stored per unit volume of the spring is $$\frac{E}{V} \alpha \frac{1}{2} r^2 x^2$$

and proportional to the square of the thickness (T) of the spring material but not related to the surface area (A) of the bent portions.

That is to say, the surface area (A) of the bent portions affects the elastic modulus (k) but does not affect the energy value stored in unit volume of the contact spring. Thus, by increasing the surface area (A), the repulsive force of the contact spring can be increased while keeping the energy density of the bent portions constant. Therefore, the width of the bent portions is increased in order to increase the surface area (A) of the bent portions 102*a* to 102*c*.

As described above, the structure of the contact spring that increases the width of the bent portions 102*a* to 102*c* is shown in (b) of FIG. 3.

As shown in (b) of FIG. 3, if the width of the bent portions 102*a* to 102*c* is increased, the repulsive force or elastic modulus of the contact spring is increased and the density of energy stored per unit volume is kept constant, resultantly keeping the intensity of the stress generated constant.

Moreover, as shown in (b) of FIG. 3, in a case that the width of the contact portion 101 and the width of the bent portions 102*a* to 102*c* are the same, parts of the area of the contact portion 101 may deviate from the PCB land supplying an external power in an apparatus where the contact spring 100 is to be installed, and thus it may also be possible to design the width of the end of the contact portion 101 of the contact spring 100 smaller than the width of the part connecting to the bent portion 102*a*.

Here, the design in which the width of the end of the contact portion 101 is smaller than the width of the part connecting to the bent portion 102*a* does not affect the stress distributed over the bent portions 102*a* to 102*c*. Except this design is caused from a structural reason for making it easier to set the relative location of the PCB land and the contact in the apparatus where the contact spring is used.

Meanwhile, in the contact spring structure as shown in (a) and (b) of FIG. 3, if the contact portion 101 cannot be positioned at a center part between the bent portions 102*a* to 102*c* formed at the left and right, there arises a difference in the intensity of stress between the bent portion 102*b* at the left side and the bent portions 102*a* and 102*c* at the right side, thereby making the amount of compression of the left and right bent portions difference from each other. Due to this, the x-axis direction component of the sum of vectors for moving the contact is increased, and differences in stress distribution of the left and right bent portions may become dramatic.

Hence, even in a case that the contact is not positioned at the center between the left and right bent portions, in order to make uniform the stress distributed over the respective bent portions 102*a* to 102*c*, as shown in (c) of FIG. 3, the width of the left bent portion 102*b* and the width of the right bent portions 102*a* and 102*c* may differ from each other. Further, on the connecting surfaces connecting the bent portions 102*a* to 102*c*, the width of a middle part of the connecting surfaces may be smaller than the width of the part directly connecting to the bent portions 102*a* to 102*c*.

Moreover, as shown in (a) to (c) of FIG. 3, the surface connecting the contact portion 101 and the bent portion 102*a* may be sloped so as to prevent the bent portion 102*a* at the topmost side from contacting the PCB surface.

FIG. 4 is view showing a coin type vibration motor 200 for which a contact spring is used according to the present invention.

As shown in FIG. 4, in a contact spring 100 according to the present invention, the support portion 103 is supported, being coupled to the structure of the vibration motor 200, and the contact portion 101 comes in contact with a PCB land and can be used as a connection terminal for supplying a power source. Here, the contact spring 100 can generate vibration from the vibration motor 200 by receiving power from outside and delivering the received power to a vibrating portion that eccentrically rotates.

The contact spring 100 according to the present invention is applicable to various electrical equipment of such a structure receiving power from outside as well as a vibration motor, and can ensure a reliable power supply to such electrical equipment.

As seen from above, the contact spring according to the present invention have a high reliability because with energy dispersed and stored in two or more bent portions, the strain-energy density stored in the bent portions of the contact spring is reduced, and thus the magnitude of the stress distributed over the bent portions is reduced.

INDUSTRIAL APPLICABILITY

According to the present invention, the strain-energy density stored in the bent portions of the contact spring is reduced, and thus the magnitude of the stress distributed over the bent portions is reduced, thereby providing a contact spring having a higher durability.

Furthermore, according to the present invention, the rotation phenomenon of the contact is reduced by adjusting the width of each bent portion and bent portion joint according to the relative location of the contact portion and the bent portion, and thus the amount of change in the relative location of the PCB land of the terminal and the contact can be reduced.

Furthermore, the contact spring is prevented from permanent deformation due to compression by uniformly dispersing the stress distributed over each bent portion by adjusting the width of the bent portion.

The invention claimed is:

1. A vibration motor, comprising:

a contact spring including:

a support portion;

a first intermediate portion having one end extending from the support portion;

a first bent portion extending from the end of the first intermediate portion opposite the end at the support portion;

a second intermediate portion having one end extending from the first bent portion, the second intermediate portion overlying and being spaced from the first intermediate portion;

a second bent portion extending from the end of the second intermediate portion opposite the first bent portion;

a third intermediate portion having one end extending from the second bent portion, the third intermediate portion overlying and being spaced from the second intermediate portion;

a third bent portion extending from the end of the third intermediate portion opposite the second bent portion; and a contact portion having one end extending from the third bent portion, the contact portion electrically connected to an external power supply terminal; and a vibrating portion eccentrically rotating by power supplied from outside through the contact spring.

2. The vibration motor of claim 1, wherein the bent portions are constructed in a semicircular shape or '⊂'-shape.

3. The vibration motor of claim 1, wherein the width of each of the bent portions is different from each other according to their location.

4. The vibration motor of claim 1, wherein the bent portions have the same width.

5. The vibration motor of claim 1, wherein the width of the end of the contact portion is smaller than the width of the third bent portion.

6. The vibration motor of claim 1, wherein the contact portion is bent with a given curvature.

7. The vibration motor of claim 1, wherein fourth intermediate portion connecting the contact portion to the third bent portion is sloped so as to prevent the third bent portion from contacting a PCB surface of the external power supply terminal.

8. The vibration motor of claim 1, wherein the strain energy generated in the entire bent portions is stored dispersed in the first, second, and third bent portions.

9. The vibration motor of claim 1, wherein the width of at least one of the intermediate portions connecting the corresponding bent portions is at least partially smaller in width than the width of the corresponding bent portions.

10. A vibration motor, comprising:

a contact spring including:

a support portion;

a contact portion electrically connected to an external power supply terminal; and at least two bent portions connected between the support portion and the contact portion and having a bent shape, the width of each bent portion being different from each other according to their location; and a vibrating portion eccentrically rotating by power supplied from outside through the contact spring.

11. A vibration motor, comprising:

a contact spring including:

a support portion;

a contact portion electrically connected to an external power supply terminal; and at least two bent portions connected between the support portion and the contact portion and having a bent shape, the width of the contact portion being smaller than the width of the part connecting to the bent portions; and a vibrating portion eccentrically rotating by power supplied from outside through the contract spring.

12. A vibration motor, comprising:

a contact spring including:

a support portion;

a contact portion electrically connected to an external power supply terminal; and at least two bent portions connected between the support portion and the contact portion and having a bent shape, the width of the at least one of the connecting surfaces connecting the bent portions is at least partially smaller width than the width of the bent portions; and a vibrating portion eccentrically rotating by power supplied from outside through the contact spring.

* * * * *